United States Patent [19]

Poncet

[11] Patent Number: 4,714,497

[45] Date of Patent: Dec. 22, 1987

[54] PROCESS FOR THE PREPARATION OF FERROUS PARTS OF A COLOR TELEVISION TUBE AND FURNACE FOR OPERATING SUCH A PROCESS

[75] Inventor: Bernard Poncet, Lyons, France

[73] Assignee: Videocolor, Montrouge, France

[21] Appl. No.: 577,401

[22] Filed: Feb. 6, 1984

[51] Int. Cl.[4] ..... C23C 8/14

[52] U.S. Cl. ..... 148/6.35

[58] Field of Search ..... 148/6.35

[56] References Cited

U.S. PATENT DOCUMENTS

| | | | |
|---|---|---|---|
| 2,543,710 | 2/1951 | Schmidt | 148/6.35 |
| 2,591,460 | 4/1952 | Morrill | 148/6.35 |
| 3,307,981 | 3/1967 | Katsahmias | 148/6.35 |
| 3,479,232 | 11/1969 | Broussard | 148/6.35 |
| 4,285,106 | 8/1981 | Adler . | |

OTHER PUBLICATIONS

Valvo Report, vol. XVIII, Section ½, Apr. 1974, pp. 83 to 87, (and translation).

Patent Abstracts of Japan, vol. 4, No. 48, (E-6), (530), p. 105, (E-6), (Tokyo, JP) & JP-A-5519715, (Hitachi Seisakusho K.K.), 12-2-80.

Patent Abstracts of Japan, vol. 5, No. 24, p. 696(C-43) & JP-A-55152182, (Kantou Yakin Kogyo K.K.), 27-1-1-80.

Patent Abstracts of Japan, vol. 6, No. 115, Jun. 26, 1982, (Tokyo, JP), p. 993, (E115), & JP-A-5744939, (Nippon Denki K.K.), 13-3-82.

*Primary Examiner*—Sam Silverberg

*Attorney, Agent, or Firm*—Pollock, Vand Sande & Priddy

[57] ABSTRACT

The present invention concerns a process for preparing ferrous parts of a color television tube and a furnace for operating such a process.

According to the invention, each ferrous part behind the base of the television tube, is prepared in a single furnace and undergoes successively an annealing, a reduction and an oxidation in three parts of the furnace 3, 4 and 5, in such a way as to eliminate the mechanical stresses, remove the rust and deposit homogeneous and adhesive layers of iron oxides I and II.

7 Claims, 2 Drawing Figures

PROCESS FOR THE PREPARATION OF FERROUS PARTS OF A COLOR TELEVISION TUBE AND FURNACE FOR OPERATING SUCH A PROCESS

BACKGROUND OF THE INVENTION

The present invention concerns a process for preparing ferrous parts of a color television tube and a furnace for operating such a process.

In order to realize a suitable image, it is known to dispose inside the glass tube constituting the shell of the cathode tube, ferrous parts such as the magnetic shield, the shadow mask and its frame. According to this technology, the mask is mounted in a frame which is placed on the rear face of the screen. A first problem concerning the object of the invention relates to the natural deposit of rust on this kind of part during manufacturing process. Indeed, for reasons of cost, mechanical and electrical behavior, the frame-mask assembly is constituted by iron that becomes oxidized in a $Fe_2O_3$ oxide. This oxide is formed on the surface of the ferrous part and spreads towards the core of the part by eroding it. There is thus a deterioration of the said part. Furthermore, slightly adhesive rust particles are thus formed which can be separated off the ferrous parts and disturb the correct operation of the tube.

Moreover, the tube comprises behind the base a cone ended by a glass neck that allows to obtain a vacuum sealed tube.

As it is known, the neck bears the electron guns and the magnetic deviation assembly. The cone is doubled inside by a magnetic shield constituted by a ferrous part that fits exactly the shape of the cone. This ferrous part allows on the one hand, to close the lines of the magnetic field emitted by the front of the deviation assembly (magnetic conduction), and on the other hand, to form a black body with the mask for the various radiations. The natural deposit of rust is also prejudicial.

A second problem concerning the object of the invention relates to the natural constitution of mechanical stresses induced in the metallic parts. These stresses must be cancelled out so that the shape of each part remains stable. An annealing treatment of the ferrous parts is thus necessary.

DESCRIPTION OF THE PRIOR ART

According to the prior art, the rust is removed by a hot chemical reduction. Then it is known in a second step to realize a particular oxidation. Indeed, it is known that $Fe_3O_4$ oxide, also called iron II oxide or magnetic oxide, possesses good magnetic conduction qualities. It is therefore worthwhile to constitute a $Fe_3O_4$ magnetic oxide deposit on the mask-frame-cone shield assembly. It should also be indicated that the sharpness of the masks is such that the reduction and the oxidation checking must also be as accurate as possible.

According to the prior art, the operations are realized separately from one another in specialized furnaces. Thus an annealing and reduction furnace and an oxidation furnace are used. An example of realization is described in U.S. Pat. No. 2,543,710. According to such an embodiment, working can only be carried out in series of parts which leads to obstructions of the production line at the inlet and exit of the treatment.

SUMMARY OF THE INVENTION

In order to overcome this drawback the present invention concerns a process for preparing ferrous parts, such as the frame, the mask, or the cone shield. The four operations of annealing, rust reduction, and first and second oxidation are carried out in a single furnace in such a way that there are successively formed on the surface of the iron, adhesive iron I oxide layers then iron II oxide, the parts to be treated passing along continuously.

The invention also concerns a single furnace in three sections: annealing reduction, first then the second oxidation.

The main advantages of the invention are:

a considerable reduction of manufacturing costs;

an improvement of the physical-chemical qualities of the ferrous parts.

According to the particular manufacturing methods due to the nature or the origin of the parts, treatments other than those described herein are to be envisaged. Oil removal of the parts delivered to the assembly line, rolling of the mask, etc. can be cited. These operations, neither excluded nor avoided by the process according to the invention, do not concern the object of the invention.

BRIEF DESCRIPTION OF THE DRAWING

Other advantages and characteristics of the present invention will be developed throughout the following description given with reference to the figures in which.

DESCRIPTION OF THE PREFERRED EMBODIMENTS

In the following description, an example of treatment of the frames will be given. For the other ferrous parts, it is necessary to adapt the thermal cycles in function of the thermal capacities of each type of part. According to the invention, in a single passage each ferrous part undergoes:

an annealing, a reduction, a first oxidation, a second oxidation.

Figure 1:
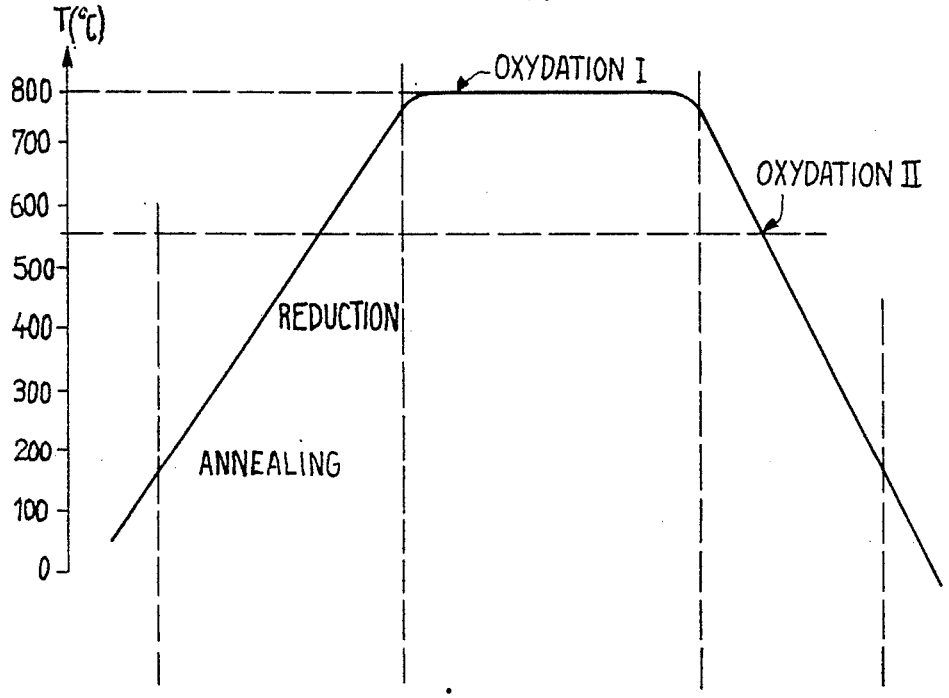
FIG. 1 represents a thermal cycle of the annealing oxidation furnace according to the invention in an example of use.
Figure 2:
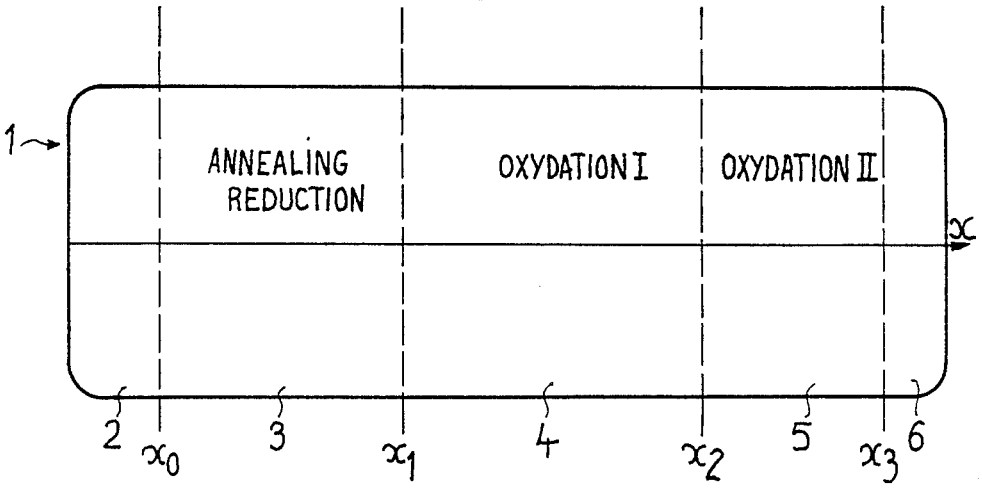
FIG. 2 represents a schematic diagram of the furnace according to the invention.

FIG. 1 indicates the distribution of temperatures within the furnace. The metallic parts are introduced into the furnace and advance continuously at variable speeds. Such a furnace is described in FIG. 2. The furnace comprises a heating body that is disposed along axis x of the furnace. On axis x, it is possible to determine three principal sections and two lock-chambers. The sections are not separated by doors or lock-chambers. An inlet lock-chamber 2 is disposed at the input of the furnace. The parts are continuously introduced into a transport element, for example a conveyor belt. They then penetrate into a first section 3, called annealing and reduction section. The annealing treatment allows reduction or elimination of the mechanical stresses in the parts. The reduction is a chemical operation that allows transformation of the rust formed in open air on the ferrous parts into pure iron. At the end of annealing and reduction section 3, mechanically satisfactory rust-free parts are thus obtained. The parts thereafter penetrate in a second section 4 called first oxidation section where the superficial iron is transformed into iron I oxide called FeO. At the end of this section 4, the parts penetrate into a second oxidation section 5. In this section, the oxidation operation consists of superficially transforming the iron I oxide layer into iron II oxide called $Fe_3O_4$. At the end of the second oxidation section 5, the parts move to an output lock-chamber by which the prepared parts depart. Along the length of the heating body, a temperature of about 760° to 780°, in the example of the frames, is reached by temperature gradients. The inlet temperature of the annealing and reduction section is about 40° C., whereas at the exit $x_1$ of the section it is about 700° C. In the second section called first oxidation section 4, the temperature is stabilized at about 760° C. At abscissa $x_2$, there is a decreasing temperature gradient that leads at output of the second oxidation section 5 to a temperature of about 500° C. Then the temperature decreases in the output lock-chamber.

Such a preparation of the ferrous parts allows one to obtain very homogeneous oxide layers having good adhesion on superficial iron. Indeed, the oxidation degree increases from 0 to oxidation degree 2 continuously. This preparation has a clearly improved quality with respect to the prior art where the oxidation was carried out separately from the rust reduction.

On the other hand, a saving in the treatment cost is realized since a single furnace is used with continuous passage and the treatment time is shortened. The capacity of the manufacturing line of the tubes is thus increased.

The chemical reduction and oxidation operations are realized by coordination of the temperature cycle described with utilization of an atmosphere, chemical constituents of which are regularly proportioned. In the annealing and reduction section 3, the atmosphere used is a reducing atmosphere i.e., the oxidizing rate or oxidation ratio that is equal to the ratio between the number of reducing moles and the number of more reducing oxidizing moles has a value close to 1. According to the present invention, such an atmosphere is obtained by a gas mixer. A proportion of the products that are nitrogen $N_2$ and hydrogen $H_2$ is realized in such a way that their relative proportions are 95 and 5 parts per 100. In the embodiment, the flow-rate of the reducing atmosphere is 12.5 $m^3$ per hour.

The atmosphere used in the following sections is an oxidizing atmosphere. In such an atmosphere the oxidizing ratio has a value allowing oxidation. In the example of realization described hereinabove, in the oxidation section 4 the value of this ratio is close to 0.4 (four tenths) then 0.25 in the second oxidation section 5.

The reducing atmosphere constituted of nitrogen and hydrogen can be obtained especially by a gas mixer the reducing parts of which are permanently controlled. The oxidizing atmosphere is realized from such a reducing atmosphere by adding steam pressure that acts as an oxidizing medium.

The chemical separation of the sections is obtained by maintaining the pressure inside the furnace relatively higher than the atmospheric-pressure outside the furnace. The reducing mixture is injected in a continuous flow directed towards the furnace exit. Then the oxidizing part required is injected further along in the same direction at the level of sections 4, 5 where it mixes with the reducing flow.

The advantage of such a disposition is to allow:

prevention of the outside atmosphere from penetrating in the furnace without the necessity of complicated lock-chambers;

elimination of the door actuations between the different treatment zones.

The present invention is not limited to the treatment of one or the other of the metallic parts included behind the base in the television tube. Other atmospheres can be used in the same way.

Treatment times are, for example:

about seven minutes for the annealing reduction, about six minutes for the first oxidation, about three minutes thirty seconds for the second oxidation, about nine minutes twenty seconds to bring the parts back to their exit temperature.

This amounts to a total duration of about twenty six minutes, the parts being continuously transferred in the furnace.

I claim:

1. A method for preparing discrete ferrous components, comprising the steps:

positioning the components on a substantially planar carrier;

introducing the components into a single chamber furnace;

subjecting the components to increasing temperature in the presence of a reducing gas as it passes through a first section of the chamber wherein the pressure of the gas is above ambient and flows continuously through the chamber to a furnace exit;

subjecting the components to stable temperature in a first oxidation environment while passing through a second section of the chamber directly connected to the first section, without intervening barriers in between, wherein the reducing gas flows from the first to the second section and mixes with an oxidation gas;

subjecting the components to decreasing temperature in a second oxidation environment while passing through a third section of the chamber directly connected to the first and second sections, without intervening barriers therebetween;

directing the components out of the furnace after traversing the three sections of the single chamber, along a substantially planar path and wherein the gas in the third section exits therefrom to create gas flow through the chamber.

2. A process according to claim 1, wherein the oxidizing ratio of the gas in the first section is substantially unity for a maximum heating temperature of 760° C. so as to realize a reduction of rust on the components passing through the first section.

3. A process according to claim 2, wherein the oxidizing ratio of the gas in the second section is substantially 0.4 for a heating temperature of at least 700° C. in order to realize a superficial oxidation in iron oxide I of components passing through the second section.

4. A process according to claim 3, wherein the oxidizing ratio of the gas in the third section is substantially 0.25 for a temperature slightly lower than 550° C. so as to realize a superficial oxidation in iron II oxide of the components passing through the third section.

5. A process according to claim 1, wherein the oxidizing gas in the second or third sections is obtained from the reducing gas by addition of a water vapor flow in these sections.

6. A process according to claim 1, wherein the reducing gas is constituted by nitrogen and hydrogen in respective proportions of 95 and 5 parts per 100.

7. A process according to claim 6, wherein the nitrogen-hydrogen atmosphere is obtained by a gas mixer.

* * * * *